US005608185A

United States Patent [19]

Granholm et al.

[11] Patent Number: 5,608,185

[45] Date of Patent: Mar. 4, 1997

[54] METHOD OF REDUCING NITROGEN OXIDE FUMES IN BLASTING

[75] Inventors: Richard H. Granholm; Lawrence D. Lawrence, both of Sandy, Utah

[73] Assignee: Dyno Nobel Inc., Salt Lake City, Utah

[21] Appl. No.: 381,500

[22] Filed: Jan. 31, 1995

[51] Int. Cl.[6] ..... C06B 23/02; F42D 5/00

[52] U.S. Cl. ..... 149/108.4; 149/2; 149/46; 149/109.6; 102/332

[58] Field of Search ..... 149/2, 46, 109.6, 149/108.4; 102/332

[56] References Cited

U.S. PATENT DOCUMENTS

| | | | |
|---|---|---|---|
| 4,500,369 | 2/1985 | Tag et al. | 149/2 |
| 4,872,929 | 10/1989 | Mullay | 149/46 |
| 4,931,110 | 6/1990 | McKenzie et al. | 149/2 |
| 4,960,475 | 10/1990 | Cranney et al. | 149/2 |
| 5,026,442 | 6/1991 | Yabsley et al. | 149/2 |
| 5,159,153 | 10/1992 | Cranney et al. | 102/313 |
| 5,271,779 | 12/1993 | Engsbraten | 149/109.6 |
| 5,484,890 | 10/1995 | Evans et al. | 149/46 |

*Primary Examiner*—Charles T. Jordan
*Assistant Examiner*—John R. Hardee

[57] ABSTRACT

This invention relates to a method of reducing the formation of toxic nitrogen oxides in after-blast fumes by using an emulsion blasting agent that has an appreciable amount of urea in its discontinuous oxidizer salt phase.

6 Claims, No Drawings

METHOD OF REDUCING NITROGEN OXIDE FUMES IN BLASTING

The present invention relates to an improved method of blasting with water-in-oil emulsion blasting agents (hereafter referred to as "emulsion blasting agents"). More particularly, the invention relates to a method of reducing the formation of toxic nitrogen oxides ($NO_x$) in after-blast fumes by using an emulsion blasting agent that has an appreciable amount of urea in its discontinuous oxidizer salt solution phase.

The emulsion blasting agent used in the method of the present invention comprises a water-immiscible organic fuel as a continuous phase, an emulsified inorganic oxidizer salt solution as a discontinuous phase, an emulsifier, gas bubbles or an air entraining agent for sensitization, and urea in an amount from about 1% to about 30% by weight of the composition for reducing the amount of nitrogen oxides formed in after-blast fumes.

BACKGROUND OF THE INVENTION

Emulsion blasting agents are well-known in the art. They are fluid when formed (and can be designed to remain fluid at temperatures of use) and are used in both packaged and bulk forms. They commonly are mixed with ammonium nitrate prills and/or ANFO to form a "heavy ANFO" product, having higher energy and, depending on the ratios of components, better water resistance than ANFO. Such emulsions normally are reduced in density by the addition of air voids in the form of hollow microspheres, other solid air entraining agents or gas bubbles, which materially sensitize the emulsion to detonation. A uniform, stable dispersion of the air entraining agent or gas bubbles is important to the detonation properties of the emulsion. Gas bubbles, if present, normally are produced by the reaction of chemical gassing agents. Sensitization also can be obtained by incorporating porous AN prills.

A problem associated with the use of emulsion blasting agents in mining blasting operations is the formation of nitrogen oxides, a yellow orange-colored smoke, in the gasses produced by the detonation of the emulsion blasting agent. These gasses will be referred to herein as "after-blast fumes." Not only is the formation of nitrogen oxides a problem from the standpoint that such fumes are toxic but also these fumes are visually and aesthetically undesirable due to their yellow/orange color. Many efforts have been made to eliminate or reduce the formation of such fumes. These efforts typically have been directed at improving the quality of the emulsion blasting agent and its ingredients to enhance the reactivity of the ingredients upon initiation. Other efforts have focused on improving blast pattern designs and initiation schemes. Still other efforts have focused on improving the borehole environment by dewatering or using a more water resistant emulsion blasting agent.

It surprisingly has been found in the present invention that the formation of nitrogen oxide fumes can be reduced considerably by adding urea, in an amount from about 5% to about 30%, by weight of the composition, to the oxidizer salt solution discontinuous phase of the emulsion or in dry form or both. The urea apparently reacts chemically with any nitrogen oxides that may form as products of the detonation reaction to convert such oxides to nitrogen ($N_2$), water and carbon dioxide.

Additional advantages are realized by using urea to reduce nitrogen oxides in after-blast fumes. The use of urea in the oxidizer salt solution has been found to increase the critical diameter of the resulting emulsion blasting agent. Consequently, the emulsion blasting agent is more compatible (less reactive) with down-hole detonating cord that otherwise can cause a pre-detonation reaction to occur when the detonating cord is initiated. (The detonating cord leads to a booster located in the bottom of the borehole or a series of boosters spaced within the explosives column.) This pre-reaction itself can contribute to the formation of nitrogen oxides in after-blast fumes.

Another advantage is that the cost of using urea is considerably less than the costs of using plastic microballoons or sensitizing aluminum particles, which both have been used previously in an effort to improve the quality or reactivity of the emulsion blasting agent and its ingredients. Moreover, urea is more effective in chemically reducing nitrogen oxide after-blast fumes than these more costly alternatives.

By using urea, which is a fuel, in the oxidizer salt solution, less organic fuel can be used in the continuous organic fuel phase to achieve oxygen balance, particularly in emulsion blends containing ANFO or AN prills. This also appears to contribute to the reduction of after-blast nitrogen oxide fumes. Another advantage is that urea can extend or replace some or all of the water required in the oxidizer salt solution to result in a more energetic blasting agent.

Urea has been used or suggested for use in water-bearing blasting agents of the emulsion or water-gel type and in ANFO blasting agents. For example, U.S. Pat. No. 5,159,153 discloses the use of urea in the oxidizer salt solution phase of an emulsion blasting agent for purposes of stabilizing the blasting agent against thermal degradation in the presence of reactive sulfide and pyrite ores. U.S. Pat. No. 4,338,146 discloses the use of urea as an additive in a cap-sensitive emulsion explosive in an amount of less than 5% by weight. U.S. Pat. No. 4,500,369 discloses the use of urea in an emulsion blasting agent to lower its crystallization temperature. U.S. Pat. No. 3,708,356 discloses the use of urea to stabilize ANFO against reaction with pyrite ores. These patents do not suggest, however, the use of urea for the purposes described herein.

SUMMARY OF THE INVENTION

The invention comprises a method of reducing the formation of nitrogen oxides in after-blast fumes resulting from the detonation of an emulsion blasting agent. The method comprises using an emulsion blasting agent having an emulsifier; a continuous organic fuel phase; and a discontinuous oxidizer salt solution phase that comprises inorganic oxidizer salt, water or a water-miscible liquid and urea present in an amount from about 5% to about 30% by weight of the agent. This method particularly works well with blasting patterns that use detonating cord downlines in blasting areas that are susceptible to $NO_x$ formation and also provides a way to reduce the amount of water (that does not contribute energy to the blasting agent) and organic fuel (which may increase the formation of nitrogen oxides) required in the blasting agent composition.

DETAILED DESCRIPTION OF THE INVENTION

As indicated above the addition of urea to an emulsion blasting agent, by adding it to the oxidizer salt solution phase thereof or as a dry ingredient or both, significantly reduces the amount of nitrogen oxides formed in the detonation reaction between the oxidizer and fuel in the blasting agent. Apparently, the urea reacts with any nitrogen oxides that formed to convert them to $N_2$, $H_2O$, and $CO_2$ according to the following reaction:

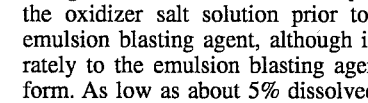

$$\text{urea} \rightarrow .NH_2 + .NCO$$

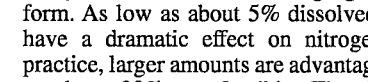

$$.NH_2 + NO \rightarrow N_2 + H_2O$$

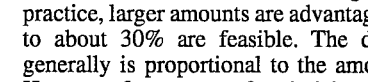

$$.NCO + NO \rightarrow N_2 + CO_2$$

Further, as mentioned, the urea-containing emulsion blasting agent also is less pre-detonation reactive to detonation cord downline, and this helps further reduce the amount of nitrogen oxides formed. Preferably the urea is dissolved in the oxidizer salt solution prior to the formation of the emulsion blasting agent, although it could be added separately to the emulsion blasting agent in a powder or prill form. As low as about 5% dissolved or dispersed urea can have a dramatic effect on nitrogen oxide reduction. In practice, larger amounts are advantageous and urea levels up to about 30% are feasible. The degree of effectiveness generally is proportional to the amount of urea employed. However, for reasons of optimizing oxygen balance, energy and effectiveness, the preferred range is from about 5 to about 20% urea.

The immiscible organic fuel forming the continuous phase of the composition is present in an amount of from about 3% to about 12% and preferably in an amount of from about 3% to less than about 7% by weight of the composition, depending upon the amount of ANFO or AN prills used, if any. The actual amount used can be varied depending upon the particular immiscible fuel(s) used, upon the presence of other fuels, if any, and the amount of urea used. The immiscible organic fuels can be aliphatic, alicyclic, and/or aromatic and can be saturated and/or unsaturated, so long as they are liquid at the formulation temperature. Preferred fuels include tall oil, mineral oil, waxes, paraffin oils, benzene, toluene, xylenes, mixtures of liquid hydrocarbons generally referred to as petroleum distillates such as gasoline, kerosene and diesel fuels, and vegetable oils such as corn oil, cotton seed oil, peanut oil, and soybean oil. Particularly preferred liquid fuels are mineral oil, No. 2 fuel oil, paraffin waxes, microcrystalline waxes, and mixtures thereof. Aliphatic and aromatic nitrocompounds and chlorinated hydrocarbons also can be used. Mixtures of any of the above can be used.

The emulsifiers for use in the present invention can be selected from those conventionally employed, and are used generally in an amount of from about 0.2% to about 5%. Typical emulsifiers include sorbitan fatty esters, glycol esters, substituted oxazolines, alkylamines or their salts, derivatives thereof and the like. More recently, certain polymeric emulsifiers, such as a bis-alkanolamine or bis-polyol derivative of a bis-carboxylated or anhydride derivatized olefinic or vinyl addition polymer, have been found to impart better stability to emulsions under certain conditions.

Optionally, and in addition to the immiscible liquid organic fuel and the urea, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Miscible liquid fuels, also functioning as liquid extenders, are listed below. These additional solid and/or liquid fuels can be added generally in amounts ranging up to about 25% by weight.

The inorganic oxidizer salt solution forming the discontinuous phase of the explosive generally comprises inorganic oxidizer salt, in an amount from about 45% to about 95% by weight of the total composition, and water and/or water-miscible organic liquids, in an amount of from about 0% to about 30%. The oxidizer salt preferably is primarily ammonium nitrate, but other salts may be used in amounts up to about 50%. The other oxidizer salts are selected from the group consisting of ammonium, alkali and alkaline earth metal nitrates, chlorates and perchlorates. Of these, sodium nitrate (SN) and calcium nitrate (CN) are preferred. When higher levels of urea, 10–15% by weight or more, are dissolved in the oxidizer solution phase, solid oxidizer preferably should be added to the formed emulsion to obtain optimal oxygen balance and hence energy. The solid oxidizers can be selected from the group above listed. Of the nitrate salts, ammonium nitrate prills are preferred. Preferably, from about 20% to about 50% solid ammonium nitrate prills (or ANFO) are used, although as much as 80% is possible.

Water preferably is employed in amounts of from about 1% to about 30% by weight based on the total composition. It is commonly employed in emulsions in an amount of from about 9% to about 20%, although emulsions can be formulated that are essentially devoid of water. With higher levels of urea, such as 15% or more, the compositions can be made anhydrous.

Water-miscible organic liquids can at least partially replace water as a solvent for the salts, and such liquids also function as a fuel for the composition. Moreover, certain organic compounds also reduce the crystallization temperature of the oxidizer salts in solution. Miscible solid or liquid fuels in addition to urea, already described, can include alcohols such as sugars and methyl alcohol, glycols such as ethylene glycols, amides such as formamide, amines, amine nitrates, and analogous nitrogen-containing fuels. As is well known in the art, the amount and type of water-miscible liquid(s) or solid(s) used can vary according to desired physical properties. As already explained it is a particular advantage of this invention that substantial urea lowers the crystallization point of the oxidizer solution.

Chemical gassing agents preferably comprise sodium nitrite, that reacts chemically in the composition to produce gas bubbles, and a gassing accelerator such as thiourea, to accelerate the decomposition process. A sodium nitrite/thiourea combination produces gas bubbles immediately upon addition of the nitrite to the oxidizer solution containing the thiourea, which solution preferably has a pH of about 5.5. The nitrite is added as a diluted aqueous solution in an amount of from less than 0.1% to about 0.4% by weight, and the thiourea or other accelerator is added in a similar amount to the oxidizer solution. In addition to or in lieu of chemical gassing agents, hollow spheres or particles made from glass, plastic or perlite may be added to provide density reduction.

The emulsion of the present invention may be formulated in a conventional manner. Typically, the oxidizer salt(s), urea and other aqueous soluble constituents first are dissolved in the water (or aqueous solution of water and miscible liquid fuel) at an elevated temperature or from about 25° C. to about 90° C. or higher, depending upon the crystallization temperature of the salt solution. The aqueous solution, which may contain a gassing accelerator, then is added to a solution of the emulsifier and the immiscible liquid organic fuel, which solutions preferably are at the same elevated temperature, and the resulting mixture is stirred with sufficient vigor to produce an emulsion of the aqueous solution in a continuous liquid hydrocarbon fuel phase. Usually this can be accomplished essentially instantaneously with rapid stirring. (The compositions also can be prepared by adding the liquid organic to the aqueous solution). Stirring should be continued until the formulation is uniform. When gassing is desired, which could be immediately after the emulsion is formed or up to several months thereafter when it has cooled to ambient or lower temperatures, the gassing agent and other advantageous trace additives are added and mixed homogeneously throughout the emulsion to produce uniform gassing at the desired rate. The solid ingredients, if any, can be added along with the gassing agent and/or trace additives and stirred throughout the formulation by conventional means. Further handling should quickly follow the addition of the gassing agent, depending upon the gassing rate, to prevent loss or coalescence of gas bubbles. The formulation process also can be accomplished in a continuous manner as is known in the art.

Reference to the following tables further illustrates this invention.

It has been found to be advantageous to pre-dissolve the emulsifier in the liquid organic fuel prior to adding the organic fuel to the aqueous solution. This method allows the emulsion to form quickly and with minimum agitation. However, the emulsifier may be added separately as a third component if desired.

Table I contains a comparison of two emulsion blasting agent compositions. Example A contains no urea and Example B is similar to Example A except that Example B contains 6.59% urea by weight. The urea-containing composition, Example B, had a much higher minimum booster (MB) but also a higher detonation velocity (D). Example A also contained an additional 1.3% fuel oil since no urea was present. The total water content in Example A is 12.86%, compared to 9.86% in Example B.

Table II compares theoretical energy and gas volume calculations of the examples in Table I. This table shows that urea has sufficient fuel value to eliminate part of the fuel oil in Example A.

Table III compares the detonation and fume results of Examples A & B from Table I, both with and without the presence of detonating cord downline. In all instances, the examples were tested underwater in 150 mm PVC pipe. The fume production from both examples without detonating cord was good, with Example A producing a wisp of yellow/orange smoke indicating the presence of nitrogen oxides. Example B produced no observable nitrogen oxide fumes. The differences were more dramatic when the examples were initiated with 25 grain detonating cord downline that led to a primer in the bottom of the PVC pipe. Example B, which contained urea, demonstrated a significant reduction in after-blast nitrogen oxide (yellow/orange) fumes. The qualitative smoke rating ranges from 0 (no observable fumes) to 5 (heavy, pronounced yellow/orange smoke).

Table IV provides further comparative examples. Table V shows a composition having a higher level of urea, and this composition shot well in a field application, producing good energy with no observed post-blast nitrogen oxide fumes.

While the present invention has been described with reference to certain illustrative examples and preferred embodiments, various modifications will be apparent to those skilled in the art and any such modifications are intended to be within the scope of the invention as set forth in the appended claims.

TABLE I

| | A | B |
|---|---|---|
| Oxidizer Solution 1 | 63.8 | — |
| Oxidizer Solution 2 | — | 65.9 |
| Fuel Solution | 4.8 | 4.0 |
| AN Prills | 30.0 | 30.0 |
| Fuel Oil | 1.3 | — |
| Gassing Agent | 0.1 | 0.1 |
| Results at 5° C. | | |
| Density (g/cc) | 1.18 | 1.20 |
| D, 150 mm (km/sec) | 4.5 | 5.5 |
| 125 mm | 4.4 | 5.5 |
| 100 mm | 4.1 | 4.9 |
| 75 mm | 3.7 | 3.3 |
| MB, 150 mm, Det/Fail (g) | 4.5/2.0 | 18/9 |

| Oxidizer Solution 1 | AN | NHCN[1] | $H_2O$ | Gassing Agent | $HNO_3$ |
|---|---|---|---|---|---|
| | 66.8 | 15.0 | 17.9 | 0.2 | 0.1 |
| | Fudge Point: 57° C. | | | | |
| | Specific Gravity: 1.42 | | | | |
| | pH: 3.73 at 73° C. | | | | |

| Oxidizer Solution 2 | AN | Urea | $H_2O$ | Gassing Agent | $HNO_3$ |
|---|---|---|---|---|---|
| | 74.7 | 10.0 | 15.0 | 0.2 | 0.1 |
| | Fudge Point: 54° C. | | | | |
| | Specific Gravity: 1.36 | | | | |
| | pH: 3.80 at 73° C. | | | | |

| Fuel Solution | SMO | Mineral Oil | Fuel Oil |
|---|---|---|---|
| | 16 | 42 | 42 |
| | Temperature: 60° C. | | |

[1]Norsk Hydro CN: 79/6/15: CM/AN/$H_2O$

TABLE II

| | A | B |
|---|---|---|
| AN | 42.62 | 49.24 |
| NHCN | 9.57 | — |
| Urea | — | 6.59 |
| Water | 11.42 | 9.86 |
| Gassing Agent | 0.12 | 0.14 |
| Nitric Acid | 0.06 | 0.07 |
| SMO | 0.77 | 0.64 |
| FO | 2.02 | 1.68 |
| Mineral Oil | 2.02 | 1.68 |
| AN Prills | 30.00 | 30.00 |
| FO | 1.30 | — |
| Oxygen Balance (%) | −1.49 | −2.32 |
| N (Moles Gas/kg) | 42.35 | 44.26 |
| Q Total (kcal/kg) | 734 | 698 |
| Q Gas (kcal/kg) | 701 | 689 |
| Q Solid (kcal/kg) | 34 | 8 |
| Q/880 | 0.83 | 0.79 |
| A (kcal/kg) | 729 | 697 |
| A/830 | 0.88 | 0.84 |

TABLE III

| | A | B |
|---|---|---|
| Results at 25° C. | 4.7 | 5.0 |
| D, 150 mm PVC (km/sec) | 4.5 | 4.9 |
| | 4.7 | 5.0 |
| Smoke Rating | 0–0.5 | 0 |
| | 0–0.5 | 0 |
| | 0–0.5 | 0 |
| D, 150 mm PVC (km/sec) | 4.1 | 4.8 |
| 25 Grain Cord Traced | 4.0 | 4.5 |
| | — | 4.9 |

TABLE III-continued

| | A | B |
|---|---|---|
| Smoke Rating | 3 | 0–0.5 |
| | 3 | 1 |
| | 3 | 0.5 |

TABLE IV

| | A | B |
|---|---|---|
| AN | 37.48 | 32.85 |
| $H_2O$ | 8.80 | 5.56 |
| Urea | — | 7.87 |
| Emulsifier | 0.66 | 0.66 |
| Mineral Oil | 0.33 | 0.33 |
| Fuel Oil | 2.28 | 2.28 |
| K15 Microballoons | 0.45 | 0.45 |
| ANFO | 50.00 | — |
| AN Prills | — | 50.00 |
| Oxygen balance (%) | −3.89 | −0.54 |
| N (moles/kg) | 43.81 | 43.65 |
| Q Total (kcal/kg) | 756 | 742 |
| D, 150 mm (km/sec) | 3.5 | 3.4 |
| | 3.6 | 3.3 |
| | 3.4 | 3.4 |
| | 3.7 | 3.5 |
| | 3.5 | 3.3 |
| Smoke Rating | 5 | 1 |
| | 5 | 1 |
| | 5 | 1 |
| | 5 | 1 |
| | 5 | 1 |

TABLE V

| | |
|---|---|
| AN | 34.15 |
| $H_2O$ | 6.46 |
| Urea | 14.54 (9.00 as Dry Additive) |
| Emulsifier | 0.54 |
| Mineral Oil | 0.70 |
| Fuel Oil | 2.11 |
| K15 Microballoons | 0.50 |
| AN prills | 40.00 |
| Added Fuel Oil | 1.00 |
| Oxygen balance (%) | −10.82 |
| N (moles/kg) | 43.45 |
| Q Total (kcal/kg) | 645 |

What is claimed is:

1. A method of reducing the formation of nitrogen oxide in after-blast fumes resulting from the detonation of an emulsion blasting agent, which method comprises using an emulsion blasting agent having (a) an emulsion phase comprising an emulsifier; a continuous organic fuel phase; and a discontinuous oxidizer salt solution phase that comprises ammonium nitrate and water in an amount of from about 9% to about 20% by weight of the emulsion phase, (b) ammonium nitrate prills in an amount of from about 20% to about 50% by weight of the agent, and (c) urea in an amount of from about 5% to about 30% by weight of the agent.

2. A method of reducing the formation of nitrogen oxide in after-blast fumes resulting from the detonation of an emulsion blasting agent, which method comprises using an emulsion blasting agent having (a) an emulsion phase comprising an emulsifier; a continuous organic fuel phase; and a discontinuous oxidizer salt solution phase that comprises ammonium nitrate and water in an amount of from about 9% to about 20% by weight of the emulsion phase, (b) ANFO prills in an amount of from about 20% to about 80% by weight of the agent, and (c) urea in an amount of from about 5% to about 30% by weight of the agent.

3. A method of reducing the formation of nitrogen oxides in after-blast fumes resulting from the detonation of emulsion blasting agents that have been loaded into boreholes and initiated by a combination of boosters and detonation cord downline, which method comprises using an emulsion blasting agents have (a) an emulsion phase comprising an emulsifier; a continuous organic fuel phase; and a discontinuous oxidizer salt solution phase that comprises ammonium nitrate and water in an amount of from about 9% to about 20% by weight of the emulsion phase, (b) ammonium nitrate prills in an amount of from about 20% to about 50% by weight of the agent, and (c) urea in an amount of from about 5% to about 30% by weight of the agent, whereby the emulsion blasting agent is less reactive to the energy produced by the detonating cord.

4. A method of reducing the formation of nitrogen oxides in after-blast fumes resulting from the detonation of emulsion blasting agents that have been loaded into boreholes and initiated by a combination of boosters and detonation cord downline, which method comprises using an emulsion blasting agents have (a) an emulsion phase comprising an emulsifier; a continuous organic fuel phase; and a discontinuous oxidizer salt solution phase that comprises ammonium nitrate and water in an amount of from about 9% to about 20% by weight of the emulsion phase, (b) ANFO prills in an amount of from about 20% to about 80% by weight of the agent, and (c) urea in an amount of from about 5% to about 30% by weight of the agent, whereby the emulsion blasting agent is less reactive to the energy produced by the detonating cord.

5. A method of reducing the formation of nitrogen oxides in after-blast fumes resulting from the detonation of an emulsion blasting agent, which method comprises using an emulsion blasting agent having a reduced amount of organic fuel as a continuous phase and further having (a) an emulsion phase comprising an emulsifier; organic fuel as the continuous phase in an amount less than about 7%, and a discontinuous oxidizer salt solution phase that comprises ammonium nitrate and water in an amount of from about 9% to about 20% by weight of the emulsion phase, (b) ammonium nitrate prills in an amount of from about 20% to about 50% by weight of the agent, and (c) urea in an amount of from about 5% to about 30% by weight of the agent.

6. A method of reducing the formation of nitrogen oxides in after-blast fumes resulting from the detonation of an emulsion blasting agent, which method comprises using an emulsion blasting agent having a reduced amount of organic fuel as a continuous phase and further having (a) an emulsion phase comprising an emulsifier; organic fuel as the continuous phase in an amount less than about 7%, and a discontinuous oxidizer salt solution phase that comprises ammonium nitrate and water in an amount of from about 9% to about 20% by weight of the emulsion phase, (b) ANFO prills in an amount of from about 20% to about 80% by weight of the agent, and (c) urea in an amount of from about 5% to about 30% by weight of the agent.

* * * * *